US007840166B2

(12) United States Patent
Schlageter et al.

(10) Patent No.: US 7,840,166 B2
(45) Date of Patent: Nov. 23, 2010

(54) DEVICE AND METHOD FOR DOSING TONER MATERIAL IN AN ELECTROPHOTOGRAPHIC PRINTER OR COPIER

(75) Inventors: Bernhard Schlageter, Gōrwihl (DE); Klaus Ströl, Gelting (DE); Reinhold Schmidl, Fürstenfeldbruck (DE); Josef Ranner, Ebersberg (DE); Bernd Schoch, Heimstetten (DE); Joseph Knott, Tutzing (DE)

(73) Assignee: Oce Printing Systems GmbH, Poing (DE)

( * ) Notice: Subject to any disclaimer, the term of this patent is extended or adjusted under 35 U.S.C. 154(b) by 0 days.

(21) Appl. No.: 12/480,255

(22) Filed: Jun. 8, 2009

(65) Prior Publication Data

US 2009/0245881 A1 Oct. 1, 2009

Related U.S. Application Data

(62) Division of application No. 10/515,603, filed on Jul. 6, 2005, now Pat. No. 7,561,832.

(51) Int. Cl.
*G03G 15/08* (2006.01)

(52) U.S. Cl. ..... 399/258; 399/260

(58) Field of Classification Search ..... 399/27, 399/258, 260; 222/DIG. 1
See application file for complete search history.

(56) References Cited

U.S. PATENT DOCUMENTS

| | | | | |
|---|---|---|---|---|
| 2,643,032 | A | | 6/1953 | Berndt |
| 3,231,105 | A | | 1/1966 | Easley, Jr. |
| 3,367,307 | A | | 2/1968 | Lawes |
| 4,277,003 | A | | 7/1981 | Tabuchi et al. |
| 4,990,964 | A | | 2/1991 | Kraehn |
| 5,074,342 | A | | 12/1991 | Kraehn |
| 5,201,349 | A | | 4/1993 | Kraehn |
| 5,322,535 | A | | 6/1994 | Simms et al. |
| 5,430,530 | A | * | 7/1995 | Ott et al. ..... 399/260 |
| 5,727,607 | A | | 3/1998 | Ichikawa et al. |
| 5,915,154 | A | | 6/1999 | Schoch et al. |
| 6,021,294 | A | | 2/2000 | Schmidl et al. |

(Continued)

FOREIGN PATENT DOCUMENTS

| | | |
|---|---|---|
| EP | 0 238 939 | 3/1987 |

(Continued)

OTHER PUBLICATIONS

Patent Abstracts of Japan—03208066 Sep. 11, 1991.

(Continued)

*Primary Examiner*—David M Gray
*Assistant Examiner*—Laura K Roth
(74) *Attorney, Agent, or Firm*—Schiff Hardin LLP

(57) ABSTRACT

In a method or device for dosing toner material in an electrophotographic printer or copier, toner material is introduced into at least one bucket chamber rotatably arranged in an opening at a bottom of a toner reservoir. The bucket chamber has a paddle wheel which seals the opening of the toner reservoir. As the paddlewheel rotates, toner material in the bucket chamber is conveyed into a region. The toner material conveyed from the paddlewheel is further conveyed with a screw conveyor. Also a toner reservoir is provided having a toner removal opening shaped to accommodate at least a portion of a paddlewheel.

19 Claims, 9 Drawing Sheets

Section B-B

U.S. PATENT DOCUMENTS

| | | | | |
|---|---|---|---|---|
| 6,229,975 | B1 | 5/2001 | Wilhelm et al. | |
| 2004/0037591 | A1 | 2/2004 | Schlageter et al. | |
| 2005/0041998 | A1 * | 2/2005 | Fujii et al. | 399/258 |

FOREIGN PATENT DOCUMENTS

| | | | | |
|---|---|---|---|---|
| EP | 0 412 923 | | | 2/1991 |
| EP | 0 494 454 | | | 7/1992 |
| JP | 01021470 | A | * | 1/1989 |
| JP | 05088427 | A | * | 4/1993 |

OTHER PUBLICATIONS

Patent Abstracts of Japan 11282238 Oct. 15, 1999.

* cited by examiner

Section B-B

DEVICE AND METHOD FOR DOSING TONER MATERIAL IN AN ELECTROPHOTOGRAPHIC PRINTER OR COPIER

RELATED APPLICATION

The present application is a divisional of copending application Ser. No. 10/515,603, filed Jul. 6, 2005 now U.S. Pat. No. 7,561,832 titled: "Device And Method For Dosing Toner Material In An Electrophotographic Printer Or Copier".

BACKGROUND

The disclosure concerns a device and a method for dosing toner material in an electrophotographic printer or copier. To remove toner material from a toner reservoir with a removal opening below, the removal opening is alternatively opened and closed in order to control the quantity of toner material to be removed.

In electrophotographic printers or copiers, a latent charge image is generated on a light-sensitive photoconductor material, a photoconductor drum or a photoconductor band. This charge image is subsequently inked with electrically-charged toner in a developer station of the printer or copier. The inked toner image is subsequently transferred to a carrier material, for example paper, and fixed on the material.

A one-component developer or a two-component developer is used to develop the latent charge image in the developer station. The one-component developer comprises only toner particles. The two-component developer comprises a mixture of toner particles and carrier particles. In the two-component developer, the toner particles are electrically charged via movements of the two-component developer mixture. In the one-component developer, the charging of the toner particles occurs via charge transport, for example by a carrier roller.

The toner quantity necessary to generate the toner image must be supplied to the developer station in order to be able to generate further toner images. In known printers or copiers, near the developer station a temporary storage for toner material is provided from which toner material is transported into the developer station as needed or as requested.

In known printers or copiers, the temporary storage is filled with toner material from handy toner transport reservoirs through an opening directly into the reservoir, or conveyed into the temporary storage via a transport system from a separately arranged transport reservoir. In known printers or copiers, the temporary storage near the developer station has a fill level sensor. Given a minimal fill level, toner material must be supplied to the temporary storage from the toner transport reservoir. This occurs, for example, via emptying a transport reservoir into the temporary storage. In other known arrangements, sealed reservoirs filled with toner material and in the form of bottles or cartridges are adapted to an opening in the temporary storage. The bottle or cartridge is opened by pulling a slider and/or ripping open a flap, whereby the toner material can fall into the reservoir.

However, in these solutions to refill toner material into the temporary storage, a high danger of contamination exists for operating personnel and the environment of the temporary storage upon filling of the toner material and upon removal of the emptied transport reservoir. A low weight and a small structural size of the bottles and/or cartridges in fact enables a simple manipulation and a safe handling upon refilling of the temporary storage. However, given a high toner usage a frequent refilling of the reservoir is necessary, whereby long machine downtimes are created and the operating personnel are severely stressed.

A toner reservoir and a device for contamination-free exchange of such a toner reservoir in a toner transport device of a printer or copier is known from the documents U.S. Pat. No. 4,990,964 and U.S. Pat. No. 5,074,342. Toner material is transported as needed from a toner reservoir arranged separate from the developer station into the temporary storage as needed via a tube, with the aid of suction air. A vertically displaceable suction spout is immersed through an opening arranged in the top of the toner reservoir and sucks toner material out. A special formation of the toner reservoir and a laterally connected vibrating unit provide for a nearly complete emptying of the reservoir. The suction spout is drawn from the reservoir to exchange the reservoir. The opening in the toner reservoir is always arranged on top, whereby a spillage of toner is prevented. However, the conveying capacity is strongly dependent on the fill state in the toner reservoir. The conveying capacity also decreases with a reduction of the fill level, such that the printing event is interrupted given a low toner level in the reservoir and a simultaneously large toner requirement in the developer station. The vibrating unit also causes disturbing noises.

An apparatus to convey toner material from a reservoir by means of a suction and pressure unit that protrudes into the reservoir is also known from the document U.S. Pat. No. 5,915,154. Toner material is interspersed with gas with the aid of the suction and pressure unit, such that the toner material to be vacuumed is mixed into a powder-gas mixture, whereby the suction of the fine-powder toner material from the reservoir is eased. However, the problem also occurs in this known device that the conveying capacity also decreases with a decrease of the fill level in the reservoir, leading to an already-described interruption of the print process as a consequence of a too-small toner material redelivery.

From the documents EP-A-0 412 923 and U.S. Pat. No. 4,277,003, devices are known that contain a conveying element rotating horizontally that seal the lower opening of the toner reservoir.

Paddlewheels to convey powdered materials are known from the documents U.S. Pat. No. 2,643,032 and U.S. Pat. No. 3,231,105.

A method is known from the document U.S. Pat. No. 6,229,975 in which a toner-air mixture is siphoned off through a filter, whereby the toner material deposits in the filter.

From the documents Patent Abstracts of Japan Vol. 2000, Nr. 01, 31 Jan. 2000 (Jan. 31, 2000), JP 11282238 and U.S. Pat. No. 5,915,154, methods are known in which a toner-air mixture is conveyed from a temporary storage into a plurality of conveyed further via rotation of the paddlewheel. The quantity of the conveyed toner material can be simply controlled via the rotary speed or via angular momentums of the paddlewheel, whereby the toner material quantity can be does in simple fashion. The conveyed quantity of toner material is thus dependent on the rotary developer stations. From the document U.S. Pat. No. 5,915,154 it is also known to provide what are known as air separators to separate air and toner.

From the document U.S. Pat. No. 5,201,349, a device is known for decanting toner from a transport container into a reservoir. A cleaning device for the mechanical removal of toner material from a filter insert that serves to separate toner and air is also known.

From the document U.S. Pat. No. 5,727,607, a method and a device to convey toner material are known in which a gaseous medium is supplied to the toner material.

From the document EP-A-0 494 454, it is also known to fluidize a powdered toner material with the aid of air. This can be excited to vibration to empty the toner reservoir.

From the document Patent Abstracts of Japan, Vol. 015, Nr. 480 (P-1284), 5 Dec. 1991 (Dec. 5, 1991)-JP03208066A, a toner supply reservoir is known with side walls running downwards at an incline to one another.

SUMMARY

It is an object to specify a device and a method to dose toner material in an electrophotographic printer or copier in which a quantity of toner material to be conveyed from the reservoir can be adjusted simply.

In a method or device for dosing toner material in an electrophotographic printer or copier, toner material is introduced into at least one bucket chamber rotatably arranged in an opening at a bottom of a toner reservoir. The bucket chamber has a paddle wheel, which seals the opening of the toner reservoir. As the paddlewheel rotates, toner material in the bucket chamber is conveyed into a region. The toner material conveyed from the paddlewheel is further conveyed with a screw conveyor. Also a toner reservoir is provided having a toner removal opening shaped to accommodate at least a portion of a paddlewheel.

DESCRIPTION OF THE PREFERRED EMBODIMENTS

Figure 1:
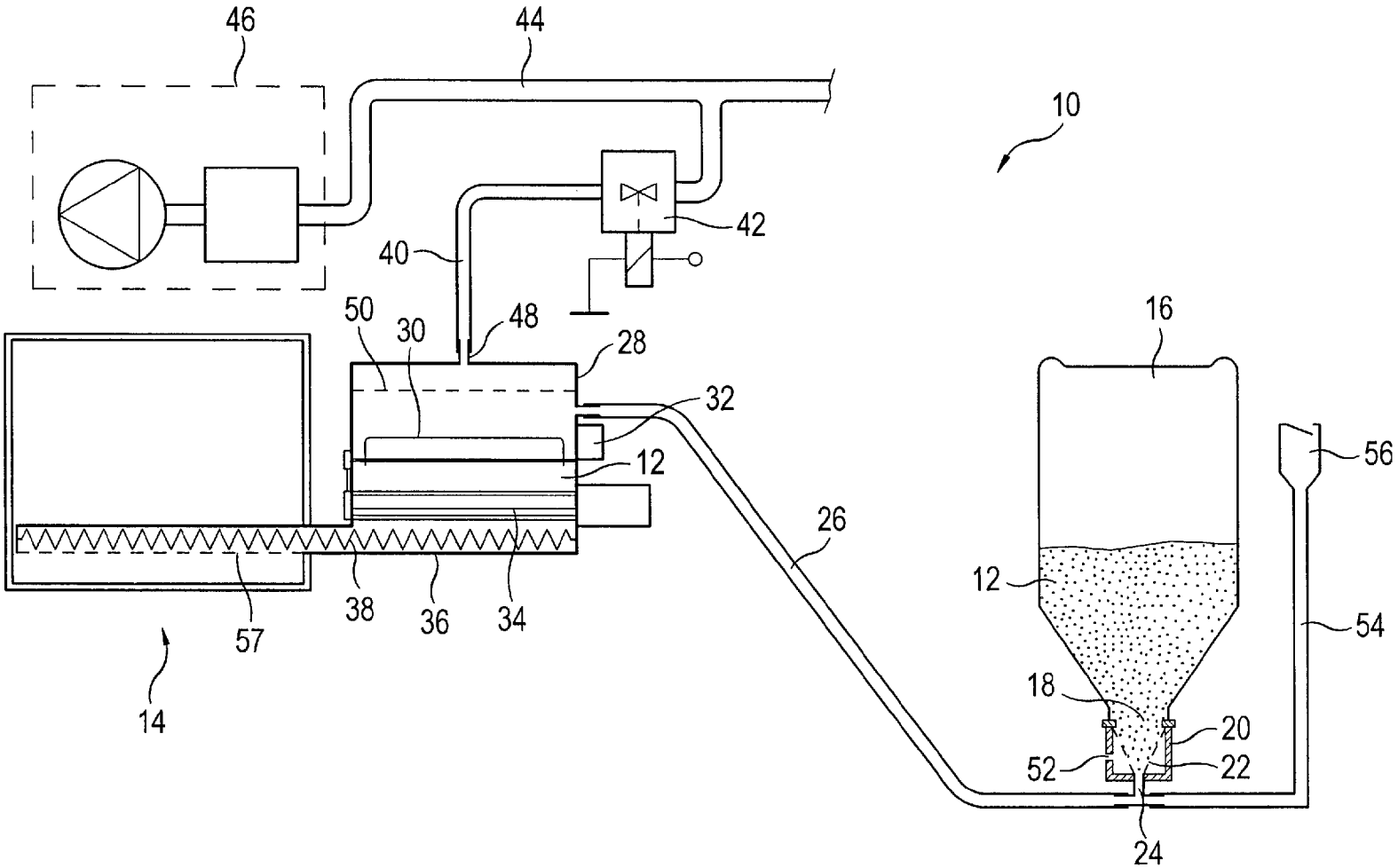
FIG. 1 is a schematic design of a toner conveyance system in an electrophotographic printer or copier.

For the purposes of promoting an understanding of the principles of the invention, reference will now be made to the preferred embodiments illustrated in the drawings and specific language will be used to describe the same. It will nevertheless be understood that no limitation of the scope of the invention is thereby intended, such alterations and further modifications in the illustrated device, and/or method, and such further applications of the principles of the invention as illustrated therein being contemplated as would normally occur now or in the future to one skilled in the art to which the invention relates.

In the device, toner material slides downwards through the removal opening of the toner reservoir into a bucket chamber of a paddlewheel. The toner material is conveyed further via rotation of the paddlewheel. The quantity of the conveyed toner material can be simply controlled via the rotary speed or via angular momentums of the paddlewheel, whereby the toner material quantity can be dosed simply. The conveyed quantity of toner material is thus dependent on the rotary speed as well as the number and volume of the bucket chambers. If too much toner material is conveyed by the paddlewheel via the device and toner material accumulates below the paddlewheel, toner material simply remains in the bucket chamber. The toner material is thereby neither compressed nor damaged.

In a development of the preferred embodiments, sealing elements are arranged at the circumferential sides in the region to the right and left of the rotation axle. Upon rotation of the paddlewheel, the paddles are directed past these sealing elements, whereby the opening of the toner reservoir can be sealed airtight by the paddlewheel. If, for example, toner material is conveyed into the toner reservoir with the aid of negative pressure, it is necessary that the toner reservoir is airtight and that air flows back via a toner conveyance conduit. The opening of the toner reservoir for the extraction of toner material must thus be sealed airtight.

In another embodiment, at least in the region of the removal opening, the toner reservoir has gas-permeable regions through which air can flow into the toner reservoir, and a free-flowing toner material-air mixture is created at least in these regions. Such a toner material-air mixture can simply flow through the removal opening of the reservoir into the bucket chamber and flow out again from this bucket chamber after rotation of the paddlewheel. The toner material-air mixture can also subsequently be conveyed in simple fashion. Solidified toner material is loosened in the toner reservoir via the supplied air. Deposits of toner material, or what are known as toner material cornices, are prevented by the supplied air and existing are loosened again.

A second aspect of the preferred embodiment concerns a method for dosing toner material in an electrophotographic printer or copier. The advantageous technical effects specified for the method also relate to the method for dosing toner material.

A third aspect of the preferred embodiment concerns a method for the separation of toner material and air from a toner material-air mixture. In this method, in a first operating phase a toner material-air mixture is supplied to a filter. At least air thereby flows through the filter in a first direction.

In a second operating phase, the flow of air through the filter in the first direction is interrupted such that toner material deposited on the filter is loosened therefrom. With this method it is achieved that the filter is not clogged by toner material deposited on the filter, and only a small quantity of air can be conveyed through the filter. Such a method can, for example, be used to deposit toner material when toner material is conveyed with the aid of negative pressure. The filter is then arranged in front of the negative pressure unit to generate the negative pressure, in order to prevent toner material from penetrating into the negative pressure system. A predetermined air flow is necessary to convey toner material with the aid of such a negative pressure. This air flow is only ensured when the filter is not, or is only slightly afflicted, with toner material. Via the second operating phase it is ensured that toner material that has deposited on the filter system is simply removed therefrom. In the first operating phase, the air flow through the filter system can thereby, for example, be aligned vertically upwards. In the second operating phase it is thereby achieved that the toner material simply falls downwards from the filter system.

In an advantageous embodiment, in the second operating phase air flows through the filter system in a second direction approximately opposite to the first direction. It is thereby achieved that toner material that has deposited in the filter system can also be loosened from this again. Even given large adhesion forces between toner material and filter, for example as a consequence of electrostatic forces, the toner material can be particularly simply loosened from the filter system with the aid of the air flow. Further additional means, such as vibrating units or scrapers, are not necessary to clean the filter system.

In another advantageous development, the first operating phase and second operating phase alternate with one another, whereby the first operating phase comprises a time of approximately two seconds and the second operating phase comprises a time of approximately one second. It is thereby achieved that the filter system is continuously cleaned and deposits are effectively prevented in the filter system. Clogs of the filter system can thus not even be created in the first place.

In a fourth aspect, a device is specified for the division of toner material and air. This device essentially comprises in order to execute the method according to the third aspect of the invention. The technical effects and advantages specified in the method according to the third aspect are thus correspondingly also true for the device to separate toner material and air.

In a fifth aspect that can in particular be combined with the third and fourth aspects, a dosing device is provided with a temporary toner storage that comprises a guide device for the toner-air mixture as well as air-permeable funnel-shaped side walls designed inclined towards one another through which a slight air overpressure can be blown into the temporary storage. This weak overpressure is in particular adjustable and has the effect that no interfering toner deposits can also form on the side walls of the temporary storage. In particular sinter metals and sinter plastics have proven to be suitable as material for the air-permeable regions (side walls). The pore size of the air-permeable regions is in particular in the range of 0.1 to 100 μm. Depending on the pore size, a given overpressure has proven to be advantageous, whereby in tests by the applicant, for example for an average pore size of 0.2 μm, an overpressure of approximately 19 mbar has proven to be ideal. The arrangement of the temporary toner storage is in particular also suitable for the dosed dispensing of toner into a developer station, whereby relative to arrangements with agitators it has the advantage that no mechanical moving devices ((such as agitators) via which the toner is crushed, ground on other materials (such as that of the walls and agitators)) are necessary, and thus the toner experiences a significantly lesser mechanical and electrostatic modification. Since the blown toner is in practice completely loosened from the side walls of the intermediate reservoir and from the filter, the toner quantity dispensed from the temporary storage to the dosing opening can be very exactly determined via the injection pressure and the tube cross-section of an injection tube and be maintained without additional dosing system such as agitators, scrapers or the like being necessary.

According to a sixth aspect, a method is specified for the supply of toner material to a plurality of developer stations. In this method, in a first operating phase toner material is supplied via an air flow from a toner reservoir into a first temporary storage of a first developer station. In a second operating phase, toner material is supplied via an air flow from a toner reservoir into a second temporary storage of a second developer station. It is thereby achieved that two developer stations can be supplied with toner material from one toner reservoir. For example, the design of a printer with two developer stations is thereby significantly simplified. Even when a plurality of printers are supplied with toner material from one toner reservoir, the design of the printer is simplified via a central supply of the developer stations with toner material. The refilling of toner material into a plurality of developer stations is significantly simplified for an operating person, since he must only exchange one toner reservoir for a plurality of developer stations. Via the method it is in particular advantageous to use large toner reservoirs with a volume to receive 5 to 30 kg of toner material. These large print jobs can also be executed without operator control actions to refill toner material being necessary. Downtimes can be significantly reduced.

In a development of the method, in a third operating phase toner material deposited on a filter is removed therefrom. It is thereby achieved that a filter system that is provided in the printer or copier in order to separate toner material and air from a toner material-air mixture is cleaned of toner material, and thus a clogging of the filter system is prevented. In the third operating phase, for example, air can thereby flow through the filter system that is opposite the flow direction in which air flows through the filter system to separate the toner material-air mixture. Adhered toner material is thereby also loosened again at the filter system.

It is particularly advantageous to continuously execute the operating phases in succession, whereby preferably the first operating phase and the second operating phase respectively have a duration of approximately two seconds and the third operating phase has a duration of approximately one second. A fourth operating phase, in which the same method steps as in the third operating phase are executed, can also be implemented between the first operating phase and the second operating phase. It is thereby ensured that respectively the same conveying capacity is possible in the first operating phase and the second operating phase, and that a sufficient quantity of air can also be drawn through the filter system in the second operating phase.

The first operating phase and the second operating phase are respectively only executed when, in the associated developer station a pre-set fill level of toner material is not achieved in the temporary storage of the developer station. Upon under-running the desired value, toner material is then no longer conveyed into this temporary storage, i.e. the first or, respectively, second operating phases are not implemented. If the first operating phase and the second operating phase are not executed due to the fill levels in the temporary storages of the developer station, the third operating phase is also not executed in an advantageous manner.

In this context, the patent applications with the internal file number 2000E0510 and 98E801 (submitted by the applicant at the same time as this patent application) are referenced, the patent applications concerning a method and a device to convey toner material from a reservoir. Both of these patent applications are herewith incorporated by reference into the present specification.

For better understanding, reference is made in the following to preferred exemplary embodiments, shown in the drawings.

A toner conveyance system 10 of a printer or copier is shown in FIG. 1. The toner conveyance system 10 serves to supply toner material 12 into a developer station 14. The toner material 12 is supplied to the printer or copier (not shown) via a reservoir 16 in which the toner material 12 is contained. A discharge opening 18 serves for the removal of toner material 12. It is shown in a second, lower position, as is explained further below. A sealing device 20 is connected in toner-sealed fashion with the toner reservoir 16 such that toner material 12 slides from the reservoir 16 into the sealing device 20.

The sealing device 20 comprises a funnel 22 into which the toner material 12 slides from the reservoir 16. The funnel 22 has a funnel outlet 24 connected airtight and toner-sealed with a tube system 26. The tube system 26 connects the funnel outlet 24 with a temporary storage 28 arranged near the developer station 14 and in which toner material 12 is temporarily stored for further transport into the developer station 14. The temporary storage 28 comprises a stirring clip 30, a fill level sensor 32 and a dosing device 34 that comprises a paddlewheel. A toner conveyance tube 36 with a toner conveyance spiral 38 connects the temporary storage 28 with the developer station 14 and conveys toner material 12 as needed from the temporary storage 28 to the developer station 14. With the aid of the dosing device 34 and/or the conveyance tube 36, which are respectively connected with a drive device (not shown), the quantity of toner material 12 conveyed into the developer station 14 is adjusted and dosed.

The stirring clip 30 stirs the toner material 12 into the temporary storage 28. The temporary storage 28 is airtight, whereby the airtight sealed chamber of the temporary storage 28 is connected with a central negative pressure line 44 via a tube system 40 that comprises a control valve 42. A negative pressure is generated in the central negative pressure line 44 via a vacuum blower 46. The tube system 40 is connected with an upper section of the temporary storage 28. A filter 50 is arranged below the connection location 48, facing the sealed chamber. The temporary storage 28 is connected with the tube system 26 below filter 50. The control valve 42 regulates the negative pressure in the tube system 49 as well as in the temporary storage 28 connected with this and in the tube system 26. This negative pressure provides that toner material 12 is transported from the funnel outlet 24 of the sealing device 20 into the chamber of the temporary storage 28 via the tube system 26.

The quantity of the conveyed toner material 12 can be analogously adjusted with the aid of the control valve 42 in many positions. However, in other exemplary embodiments the control valve 42 can also be operated in an on-off function, whereby the conveyed quantity of toner material 12 then depends on the negative pressure in the tube system 44 and the opening time of the control valve 42. Funnel 22 has porous, air-permeable funnel walls. Air is sucked through sealing device 20 into the funnel 22 through the funnel walls via the negative pressure at the funnel outlet 24. In the funnel 22, a toner-air mixture is generated which has fluid-like, what are known as fluidic properties. The air supplied through the opening 52 can be controlled via a valve (not shown). The funnel outlet 24 is also connected with a tube system 54 to a control valve 56 via which environmental air can be supplied to the tube system 56. Furthermore, a back-pressure valve (not shown) that prevents an escape of the toner material even given disadvantageous pressure ratios in the tube systems 44, 26, 54 is provided in the control valve 56. The quantity of toner material 12 that is conveyed from the reservoir 16 into the temporary storage 28 can be regulated via the control valve 56.

The control valves 42 and 56 are electrically-actuated valves. The negative pressure ratios in the temporary storage 28 and in the tube system 26 can be set exactly with the aid of the control valve 42. The toner transport from the reservoir 16 into the temporary storage 28 is regulated corresponding to the signal of the fill level sensor 32. The control valve 42 and the control valve 56 serve, as already mentioned, as actuators of the regulation. The suction air necessary for the toner transport is set via these control valves 42, 56. The toner material 12 exiting from the funnel outlet 24 is carried away by the air current in the tube system 26, 54 and transported to the temporary storage 28. The filter 50 in the temporary storage 28 prevents the further transport of the toner material 12 into the tube system 40.

After the sealing of the valve 42, the clear air side of the filter 50 is aerated to ambient pressure. A negative pressure relative to the ambient pressure in the tube system 40 is thereby at least temporarily in the temporary storage 28. In the following pressure equalization between the tube system 40 and the temporary storage, air flows from the tube system 40 through the filter 50 into the temporary storage 28. The air current upon pressure equalization is directed opposite to the air current upon suction of the toner material. Toner material 12 fixed at the filter 50 is loosened by the air current upon pressure equalization and falls into the temporary storage 28. A potentially possible escape of toner material 12 via the tube system 54 is prevented by the back-pressure valve 56. As already mentioned, the toner material 12 is transported from the temporary storage 28 into the developer station 14 with the aid of a transport tube 36. The transport tube 36 protrudes with one end into the developer station 14 and has wide openings on this end on an underside 57, through which openings the toner material 12 falls from the transport tube 36 into the developer station 14.

The transport spiral 38 contained in the transport tube 36 has a gradient such that it transports the toner material 12 in the transport tube 36 as in a screw transport tube from the temporary storage 28 to the developer station 14. The transport spiral 38 is, as already mentioned, driven with the aid of an actuating unit. The dosing device 34 comprises a roller like a paddlewheel that is arranged between the temporary storage 28 and the transport tube. Such a dosing device 34 is also designated as a cell wheel sluice. The paddlewheel-like roller nearly seals the temporary storage 28 airtight at the transport tube 36, such that air is sucked from the tube system 26 upon generation of a negative pressure with the aid of the vacuum blower 46. The paddlewheel-like roller is preferably driven synchronously with the transport spiral 38, whereby given a rotation of the paddlewheel-like roller (which is also designated as a cell wheel), toner material falls from the temporary storage 28 into the buckets or cells and is transported downwards to the transport tube 36 via the rotation.

Below the dosing device 34, the transport tube 36 has on the top an opening to the dosing device 34, such that the toner material 12 falls downwards from the cells into the transport tube 36. The stirring clip 30 inside the temporary storage 28 is driven with the aid of an actuating unit (not shown) and, via a rotation, prevents a cavity formation or cornice formation in the toner material 12 of the temporary storage 28.

Figure 2:
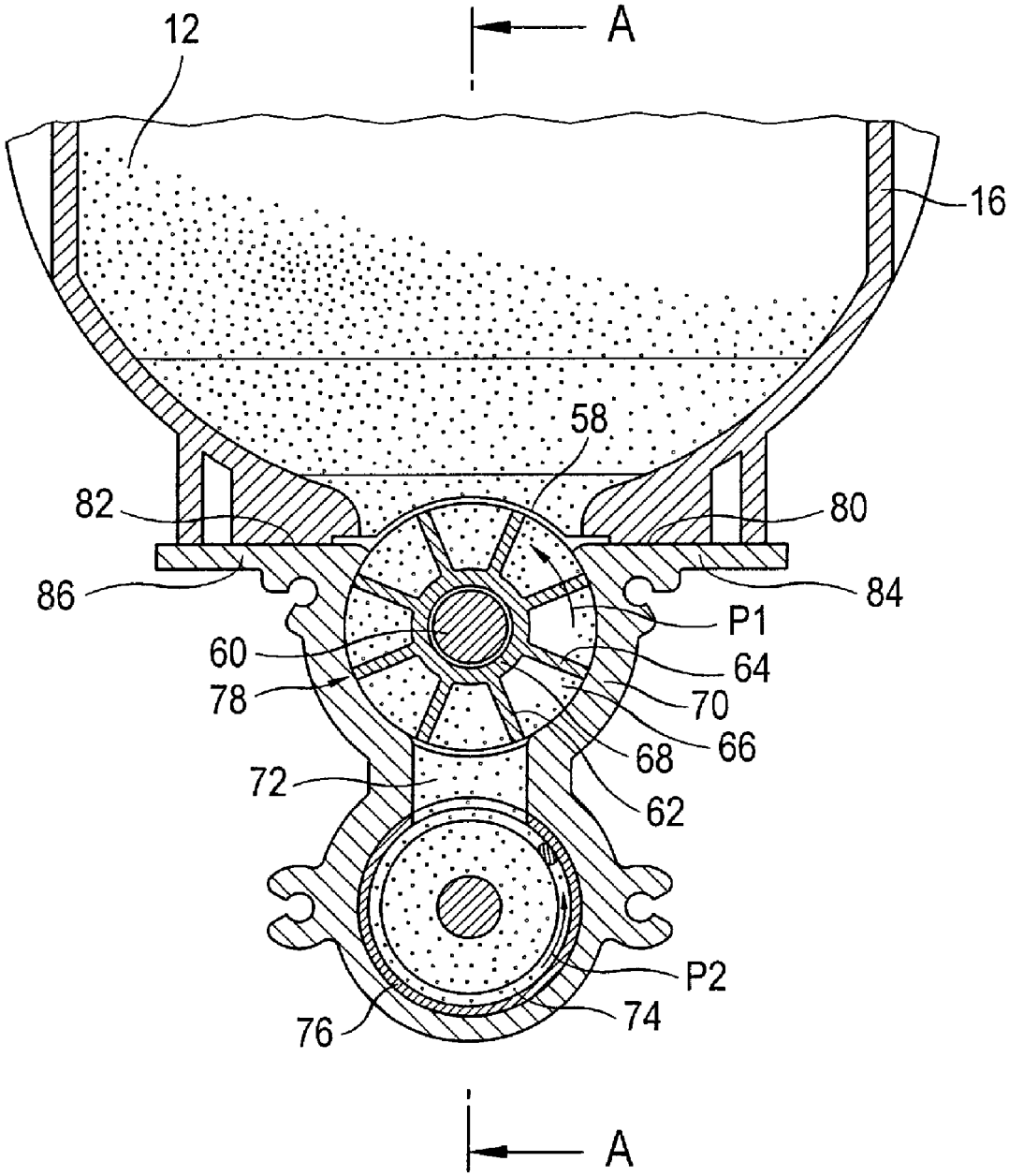
FIG. 2 is a section representation of a dosing device to convey toner material from a reservoir, whereby the section runs along the section line B-B, shown in FIG. 3 as a dash-dot line.
Figure 3:
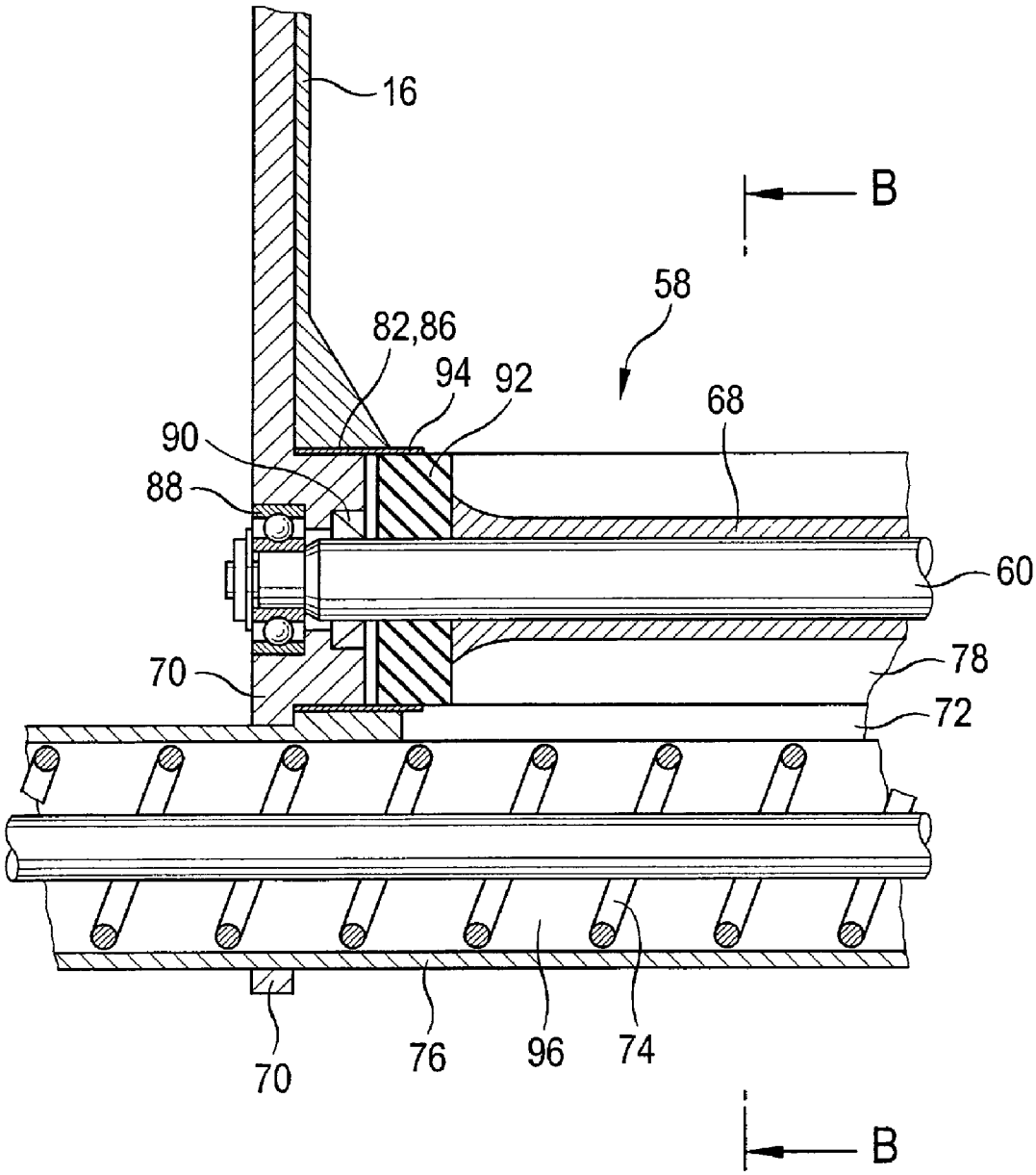
FIG. 3 is a section representation of the dosing device at the section line A-A according to FIG. 2.

FIG. 2 shows a section representation of a dosing device along a section line B-B shown in FIG. 3. In an arrangement according to FIG. 2, the reservoir 16 is arranged in a conveying position, whereby the reservoir 16 has a toner removal opening situated below through which the toner material 12 slides downwards from the reservoir. A roller 60 is arranged below the removal opening. Paddles, of which one is designated with 62 and a further one is designated with 64, are arranged on the roller surface of the roller 60. The paddles 62, 64 stick out from the roller 60 in a star shape, whereby respectively one bucket chamber 66 is formed between two adjacent paddles 62, 64. The paddles 62, 64 are connected with the roller 60 via a connection element 68. The roller 60 is partially enclosed by a housing 70, such that the paddle tips slide along on the housing 70. The paddles 62, 64 seal the toner reservoir 16 airtight and toner-tight from the housing 70 at a region 72 below the roller 60. A toner conveyance spiral 74 is arranged below the roller 60 in a toner conveyance tube 76. The toner conveyance tube 76 has an opening facing upwards towards the roller 60 along the entire length of the roller 60. The roller 60, together with the paddles 62, 64, forms a paddlewheel 78. The opening of the toner conveyance system 76, similar to the removal opening 58 in the reservoir 16, extends over the entire breadth of the paddlewheel 78.

The toner material 12 slides from the removal opening 58 into the bucket chambers 66 (open at the top) of the paddlewheel 78, whereby the toner material 12 slides through the removal opening 58 of the reservoir 16. The reservoir 16 rests on supports 84, 86 of the housing 70 with support surfaces 80, 82, whereby the reservoir 16 is sealed airtight and toner-tight with the housing 70. The paddlewheel 78 thus forms a removal or dosing device for the removal of toner material 12 from the reservoir 16.

The toner material 12 that has slid into the bucket chamber 66 is transported in the bucket chamber 66 downwards to the region 72 with a rotation of the roller 60. In the region 72, the toner material 12 falls out of the bucket chamber 66 and into the conveyor spiral 74 of the toner conveyance tube 76. If so much toner material 12 is conveyed downwards into the region 72 upon rotation of the paddlewheel 78 that this quantity is not conveyed away by the toner conveyance tube 76, the remaining quantity of toner material 12 remains in the bucket chamber 66 and is transported in the bucket chamber 66 back to the removal opening 58. In the region of the removal opening 58, the bucket chamber 66 in which a remaining quantity of toner material 12 is located is completely filled again with toner material 12 sliding from the reservoir 16. It is thereby achieved that the toner material 12 is not excessively mechanically stressed in the conveyance with the paddlewheel 78. In particular, the toner material 12 is not compressed in the regions 72 and in the toner conveyance tube 76. Only the quantity of toner material 12 that can fall into the conveying tube 76 or the quantity of toner material 12 that is conveyed away by the toner tube 76 falls from the bucket chamber 66 in the region 72. The conveying spiral 74 is driven in the direction of the arrow P2 with the aid of a drive unit (not shown). The drive unit of the conveying spiral 74 is coupled with the drive of the roller 60. The actuators and the bucket chambers 66 are designed such that, with the aid of the paddlewheel 78, a larger quantity of toner material 12 is conveyed than can be transported further through the toner conveyance tube 76 with the toner conveyance spiral 74. It is thus prevented that hollows are formed in the toner conveyance system 76. The toner conveyance system 76 is mutually arranged in the housing 70, at least in the region of the roller 60 or the paddlewheel 78.

A section representation of the dosing device according to FIG. 2 is shown in FIG. 3 along the section line A-A, whereby only a left part of this section representation is shown. Identical elements have the same reference characters. The roller 60 is rotatably supported in bearings at its ends, whereby a bearing shown in FIG. 3 is designated 88. The bearing 88 can, for example, be designed as a ball bearing or as a slide bearing. In front of the bearing 88 in the direction of the paddlewheel 78, a sealing element 90 is provided that seals a region around the paddle wheel 78 airtight and toner-tight from the bearing 88. Such a sealing element 90 can, for example, be a shaft seal or a lip seal. Furthermore, a closed porous foam material element 92 is glued with the roller 60 and the facing sides of the paddles 62, 64, the foam material element 92 sealing the paddle wheel chamber airtight from the environment with the aid of a surrounding metal bushing 94. The toner material 12 is conveyed from the reservoir 16 into the toner conveyance tube 76 with the aid of the paddlewheel 78, as already described in connection with FIG. 2, whereby it falls from the bucket chamber 66 into the intervening spaces 96 of the conveying spiral 74. With the aid of the toner conveyance tube 76, the toner material 12 can be very simply directly conveyed from the reservoir 16 into the developer station 14 as well as into or from a temporary storage 28. This arrangement requires very little space and is very cost-effective to produce. The toner material 12 is also mechanically only very slightly stressed in the transport from the reservoir 16 into the developer station 14 or the temporary storage 28. Via the conveyance with the aid of the conveying tube 76, as shown and explained in the toner conveyance system according to FIG. 1, the toner material 12 is equally distributed in a simple manner into the developer station 14 through the longitudinal opening on the underside 57 of the conveying tube 76. The dosing device according to FIGS. 2 and 3 can be particularly well-used as a dosing device 34 in the temporary storage 28. The conveying tube 76 is then functionally identical to the conveying tube 36 in order to convey toner material from the temporary storage 28 into the developer station 14. The dosing device according to FIGS. 2 and 3 thereby likewise ensures an airtight seal towards the conveying tube 36, 76 and towards the developer station 14.

The consistent toner distribution over the length of the developer station 14 is possible via the toner conveyance tube 36, 76 independent of the fill level in the temporary storage 28 or in the reservoir 16. The sealing elements 90, 92 serve primarily for the lateral sealing of the paddlewheel 78. The airtight sealing between reservoir 16 and the conveying tube 76 is achieved via the sealing of the paddle ends from the housing 70. The paddle arrangement of the paddlewheel 78 and the form of the housing 70 are thereby adapted such that at least two paddle ends on each side of the paddlewheel 78 are sealed from the housing 70 in every rotation position of the roller 60. Additionally, sealing elements (not shown) past which the paddles 62, 64 are guided upon rotation of the paddlewheel 78 can be provided in these regions on the housing 70. The paddles 62, 64 can thereby slide on the sealing elements. Both the removal opening 58 and the region 72 extend lengthwise relative to the roller 60 or on the breadth of the paddlewheel 78. It is also advantageous to arrange the walls of the reservoir 16, 28 funnel-shaped in the region of the removal opening 58 such that they run towards the removal opening 58. It is thereby achieved that the toner material 12 easily slides through the removal opening 58 into the bucket chambers 66 of the paddlewheel 78.

In other exemplary embodiments, the walls of the toner reservoir 16 are gas-permeable at least in the region of the opening 58, whereby air is supplied to the toner material 12 in the reservoir 16. With the aid of this air, at least in the region of the opening 58 a free-flowing toner material-air mixture is generated that flows into the bucket chambers 66 of the paddlewheel 78. It is particularly advantageous when the toner material 21 removed from the reservoir 16 with the aid of the paddlewheel 78 falls into a toner conveyance tube with a toner conveyance spiral or with another screw conveyer, since the toner material 12 can be particularly simply and gently transported further with the aid of such a screw conveyor.

Figure 4:
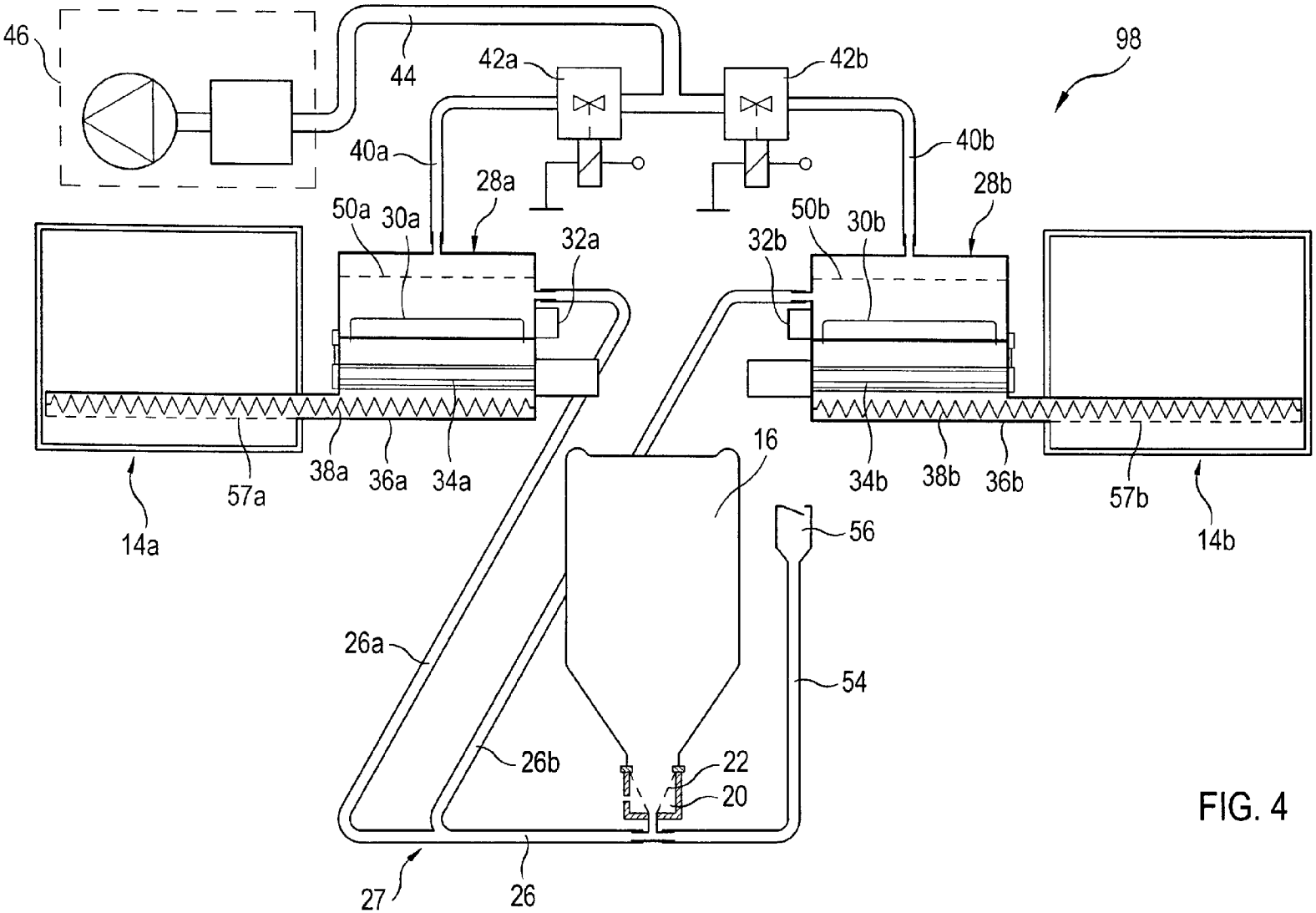
FIG. 4 illustrates a schematic design of a toner conveyance system in a printer or copier with two printing groups.

A toner conveyance system 98 similar to the toner conveyance system according to FIG. 1 is shown in FIG. 4. In contrast to the toner conveyance system according to FIG. 1, the toner conveyance system 98 is provided to supply toner material 12 into two developer stations 14*a*, 14*b*. The toner conveyance system 98 can be used in an electrophotographic printer or copier with two developer stations 14*a*, 14*b*, for example in a printer or copier in which a front side and a back side are simultaneously printed. Alternatively, the toner conveyance system 98 can also be provided to supply toner material into two developer stations that are arranged in two separate electrophotographic printers or copiers. The elements doubly provided in toner conveyance system 98 (in contrast to the toner conveyance system according to FIG. 1) are provided with the same reference characters as in the toner conveyance system according to FIG. 1, however the letter a has been appended for the elements belonging to the first developer station 14*a* and the letter b has been appended for the elements belonging to the developer station 14*b*.

The vacuum blower 46 generates a negative pressure of approximately 70 millibar at the control valves 42*a*, 42*b*. The fill level of toner material 12 in the temporary storage 28*a* or 28*b* can respectively be regulated via regulation of the suction air with the aid of the control valves 42*a*, 42*b*, whereby the quantity of toner material 12 supplied to the temporary storages 28*a*, 28*b* is removed from the reservoir 16, as has already been explained in connection with FIG. 1. One filter 50*a*, 50*b* that, for example, comprises a coated polyester felts is provided in each of the temporary storages 28*a*, 28*b*. The filter system 50*a*, 50*b* separates the toner material 12 from the sucked-in toner material-air mixture. The tube system 26 comprises a distributing piece 27 that divides the tube system into a tube system 26*a* and a tube system 26*b*, whereby toner material 12 is conveyed into the temporary storage 28*a* via the tube system 26*a* and toner material 12 is conveyed into the temporary storage 28*b* via the tube system 26*b*. As already explained in connection with FIGS. 1 through 3, the quantity of toner material 12 supplied to the respective developer stations 14*a*, 14*b* is controlled with the aid of the dosing device 34*a*, 34*b* in cooperation with the toner conveyance tube 36*a*, 36*b*. The opening at the underside of the toner conveyance tube 36*a*, 36*b* in the region of the developer station 14*a*, 14*b* provides (as already mentioned) for an equal distribution of the toner material 12 into the respective developer stations 14*a*, 14*b*. The dosing devices 34*a*, 34*b* each comprise a paddlewheel 78*a*, 78*b* and are designed similar to the dosing device according to FIGS. 2 and 3. These arrangements of the paddlewheels partition the temporary storage 28*a* airtight and toner-tight from the conveying tube 36*a* and from the environment.

Figure 5:
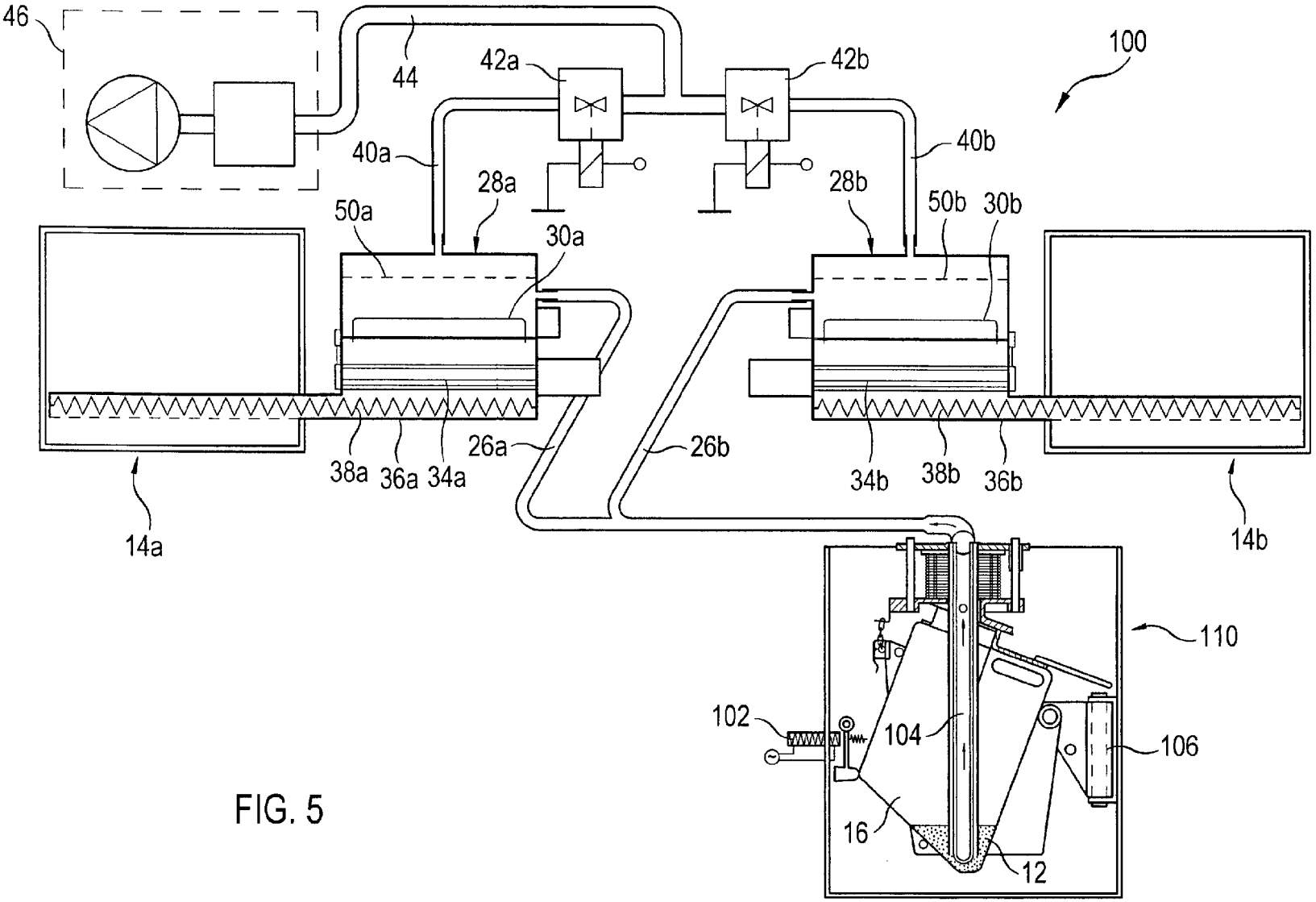
FIG. 5 is a schematic design of a second toner conveyance system in a printer or copier to supply two developer stations with toner material.

A toner conveyance system 100 similar to the toner conveyance system 98 according to FIG. 4 is shown in FIG. 5. However, in the toner conveyance system 100 the toner reservoir 16 is arranged for extraction with a removal opening situated above, whereby a dip tube 104 protrudes through the removal opening into the toner reservoir 16 for the extraction of toner material 12. The reservoir 16 is used as a supply unit 110 with the aid of a take-up device 106. The removal of toner material 12 from a reservoir 16 with the aid of a dip tube 104 is, as already mentioned in the specification introduction, specified in the documents EP-A 0311646 and U.S. Pat. No. 4,990,964. Similar to the toner conveyance system 98 according to FIG. 4, in the toner conveyance system 100 toner material is conveyed from the reservoir 16 into the temporary storage 28*a* and 28*b* with the aid of negative pressure, i.e. suction air. The suction air is adjusted with the aid of the control valves 42*a*, 42*b* corresponding to a signal of the fill level sensors 30*a*, 30*b*, and the quantity of the conveyed toner material 12 and/or the time in which toner material 12 is conveyed from the reservoir 16 into the temporary storage 28*a*, 28*b* is thereby controlled.

Figure 6:
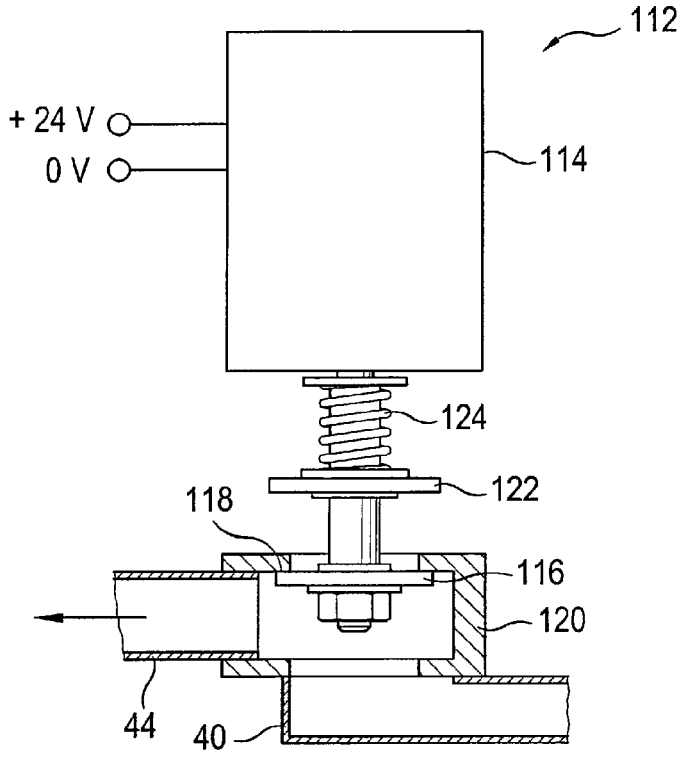
FIG. 6 is a section representation of a magnet valve to control an air flow, in an open position.

A magnet valve 112 that, for example, is used as a control valve 42*a*, and 42*b* according to FIGS. 4 and 5 is shown in FIG. 6. The magnet valve 112 has an electromagnetic actuator 114 that comprises a coil (not shown) and an armature (not shown). The magnet valve 1112 is shown in an open position in FIG. 6, whereby a first valve plate 116 is pressed against a first valve seat 118 given an activated magnet actuator 114. The magnet actuator 114 is activated with the aid of a supply voltage of 24 volts that is supplied via connection terminals of the magnet valve 112. In this open position of the magnet valve 112, the tube system 44 is connected with the tube system 40 such that air can also flow from the tube system 40 into the tube system 44 in the direction of the vacuum blower 46. In this position of the magnet valve 122, for example, toner material 12 is conveyed from the reservoir 16 into the temporary storage 28. The tube systems 40, 44 are connected airtight with a valve housing 120. Furthermore, the magnet valve 112 comprises a second valve plate 122 and a filter element 124 whose function is subsequently explained in detail in connection with FIG. 8.

Figure 7:
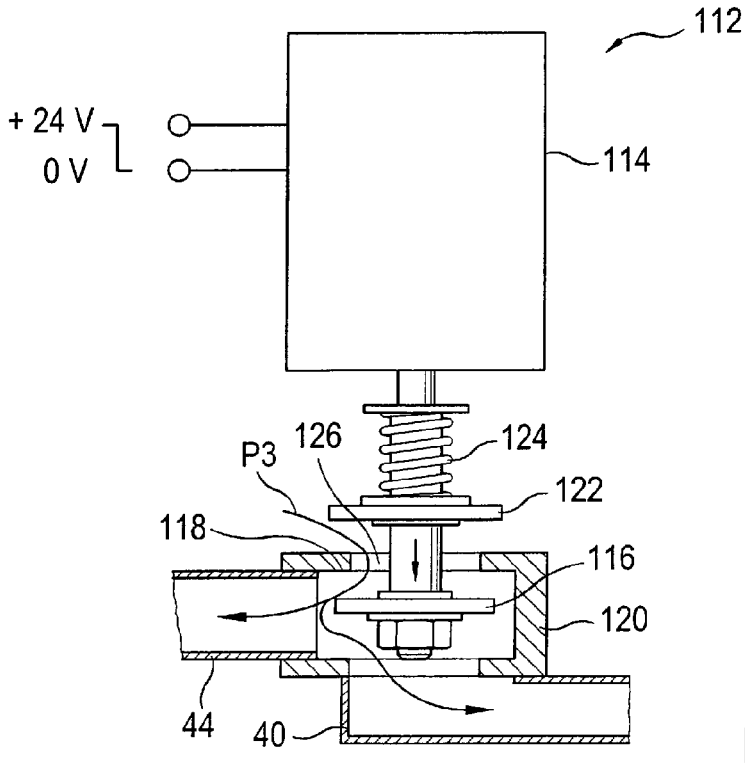
FIG. 7 shows a magnet valve according to FIG. 6 in a half-open position, whereby environment air is supplied to the tube system via the magnet valve.

The magnet valve 112 is shown in a half-closed position in FIG. 7. This position passes through the magnet valve 112 when the supply voltage of 24 volts direct voltage is disconnected. The first valve plate 116 is thereby released from the first valve seat 118, whereby an opening 126 is released next to the valve seat through which, as indicated by the arrow P3, air flows into the tube systems 40 and 44. The air flowing in causes a pressure compensation such that environment pressure is adjusted in the tube system 40 and 44. Both the movement of the first valve plate 116 and that of the second valve plate 122 are directed by the armature of the magnet valve 112, whereby the armature is pushed out from the actuator 114 with the aid of a spring (not shown) arranged in the actuator 114. Upon application of the operating voltage of 24 volts direct voltage, the armature is drawn into the actuator 114, whereby the movement is directed opposite to the spring force of the spring arranged in the actuator 114.

Figure 8:
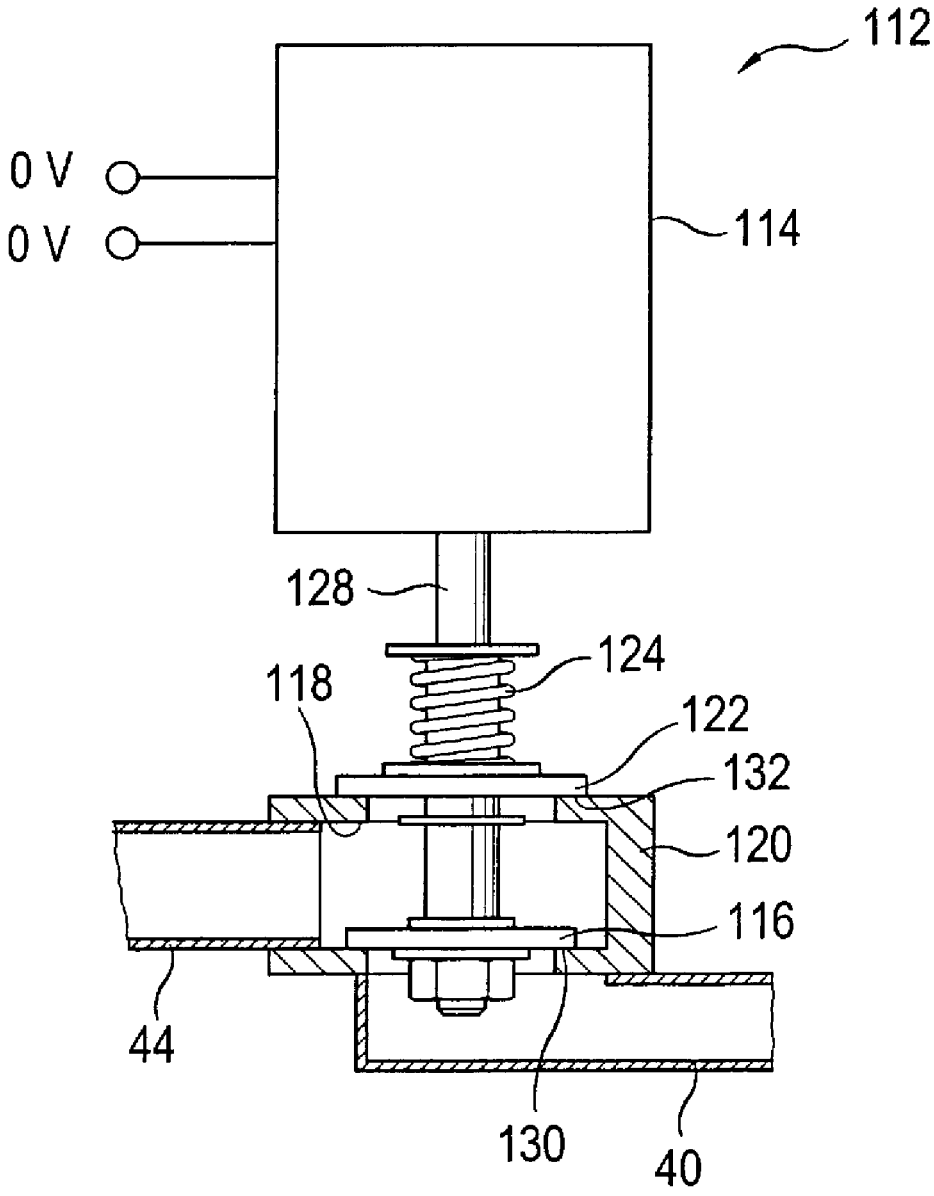
FIG. 8 illustrates the magnet valve according to FIGS. 6 and 7 in a closed position.

The magnet valve 112 is shown in a closed position in FIG. 8. The supply voltage of the magnet valve 112 is deactivated, such that the actuator 128 is pushed out from the actuator 114 so far that the first valve plate 116 presses against a second valve seat 130, whereby the second valve plate 122 presses on a third valve seat 132. The first valve plate 116 thereby seals the valve 112, whereby the tube system 44 is separated from the tube system 40 and no air can be drawn from the tube system 40 into the tube system 44. In the closed position of the magnet valve 112 shown in FIG. 8, the second valve plate 122 is pressed on the third valve seat 132 on the housing of the magnet valve 112 with the aid of the spring 12, such that air can no longer flow into the housing 120 of the magnet valve from outside. Given a closed position of one of the magnet valves 42*b*, 42*a*, the vacuum blower 46 can thus draw in air via the tube system 44 via the respective other magnet valve 42*a*, 42*b* and convey toner material 12 from the reservoir 16 into the respectively associated temporary storage 28*a*, 28*b*.

The flow of environment air into the valve housing 120 shown in FIG. 7 leads, as already described, to a pressure compensation in the tube system 44, 40 and in temporary storage 28 connected therewith. Air flows via the tube system 40 into the temporary storage 28, whereby air flowing from the tube system 40 into the temporary storage 28 flows through the filter 50. The toner material 12 that is located on the underside of the filter element 50 is loosened by this and falls downwards into the temporary storage 28. It is thereby achieved that toner material 12 that fixes to the filter 50 upon the toner material-air mixture being sucked in from the reservoir 16 via the air flow in the direction of the vacuum blower 46 is loosened again from said filter 50. Toner material 12 is preferably siphoned from into the temporary storage 28 from the reservoir 16 for two seconds and the tube system 40 is subsequently aerated for one second. It is necessary, both for the transportation of toner material 12 with the aid of suction air and for the described filter cleaning of the filter 50, that the tube systems 44, 40, 26 and the elements connected with them are executed airtight.

Figure 9:
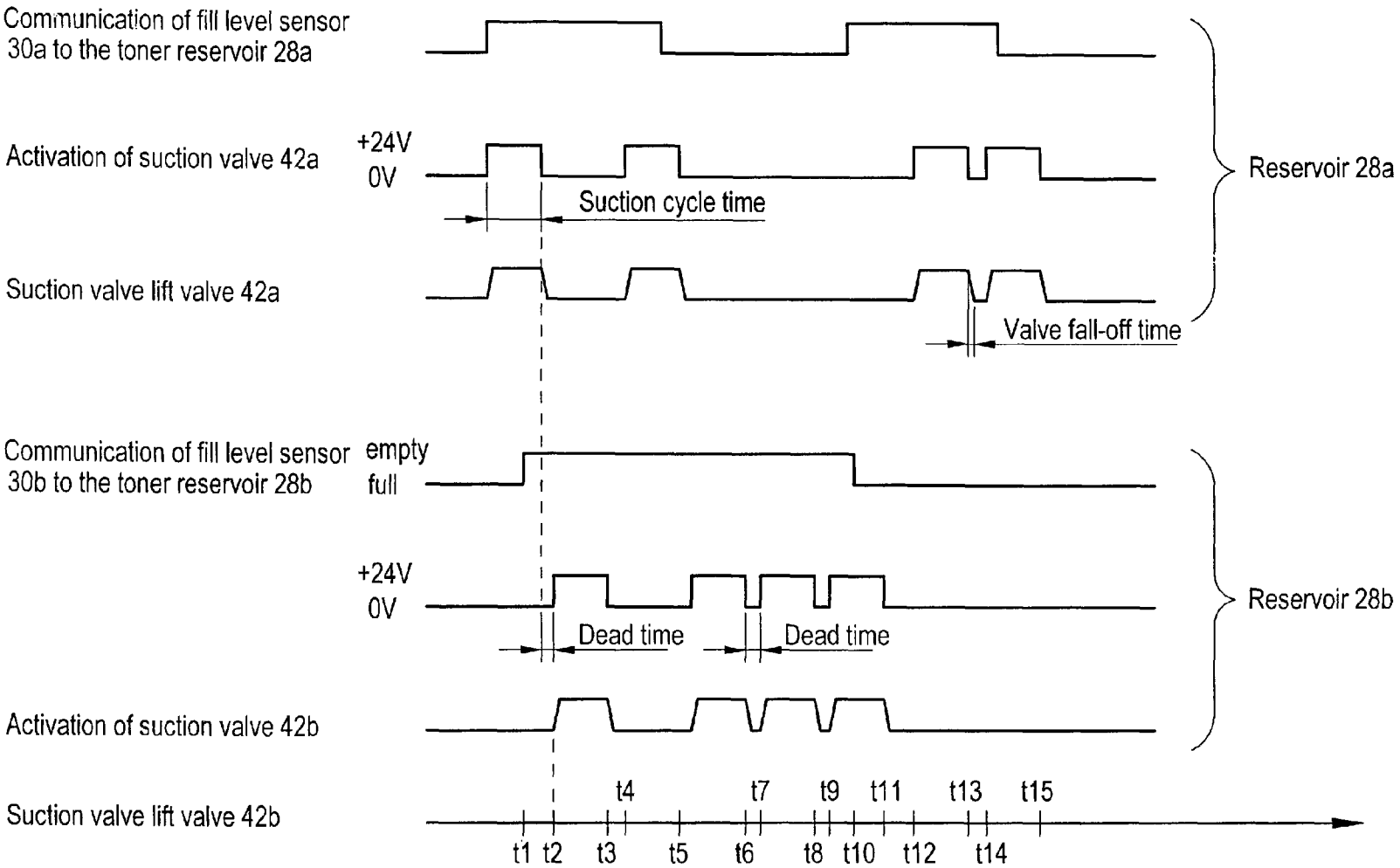
FIG. 9 shows a diagram in which the control states of the toner conveyance system are shown according to FIGS. 4 and 5.

A diagram with a control sequence for the filling of two temporary storages 28*a*, 28*b* via a toner conveyance system 98 or 100 according to FIG. 4 or 5 is shown in FIG. 9. Toner material 12 is thereby supplied from the reservoir 16 to the temporary storages 28*a* and 28*b*. At the point in time t1, the fill level sensor 20*a* states that a preset fill level of toner material 12 is not achieved in the temporary storage 28*a*. The valve 42*a* is thereby activated and opened. Toner material 12 is conveyed from the reservoir 16 into the temporary storage 28*a*. After a predetermined time of approximately two seconds, what is known as the suction cycle time, the valve 42*a* is no longer activated, whereby the valve 42*a* is closed and, as already explained in connection with FIGS. 6 through 8, upon closure of the valve 42*a* environment air flows into the tube system 40*a* to clean the filter 50*a*.

At the point in time t1, the fill level sensor 30*b* outputs a signal that a preset fill level of toner material 12 is achieved in the temporary storage 28*a*. While the valve 42*a* is activated, however, the fill level sensor 30*b* determines that the preset fill level is no longer reached in the temporary storage 28*b* and outputs a corresponding signal. After the valve 42*a* is closed, at the point in time t2 the valve 42*b* is activated and opened. After a predetermined time of approximately two seconds, the valve 42*b* is no longer activated and is closed. Between the end of the activation of the valve 42*a* and the beginning of the activation of the valve 42*b*, a predetermined time of approximately one second is waited that is also designated as a dead time. In this time, the valve 42*a* is closed, whereby (as already explained) environment air can flow into the tube system 40*a*, 44.

The activation of the valve 42*b* is ended at the point in time t3. The valve 42*b* is thereupon closed. After the dead time has elapsed, the valve 42*a* is reactivated, since (corresponding to the signal of the fill level sensor 30*a*) a preset fill level has not yet been achieved. In the subsequent suction cycle, toner material 12 is again conveyed from the reservoir 16 into the temporary storage 28*a*. For this, the valve 42*a* is reactivated at the point in time t4, whereupon the valve 42*a* is opened. After this suction cycle, at the point in time t5 the valve 42*a* is closed again and (as already explained) the filter 50 is cleaned again. During the supply of toner material 12 into the temporary storage 28*a*, the fill level sensor determines that the preset fill level has been achieved. Toner material 12 is thereby subsequently no longer conveyed into the temporary storage 28*a* until the fill level sensor 30*a* again outputs a signal that the preset fill level has been under-run.

The valve 42*b* is further activated with a plurality of suction cycles as long as the fill level sensor 30*b* outputs a signal that a preset fill level has been achieved. The valve 42*b* is thereby respectively activated and opened for two seconds and not activated and closed for one second. Upon closure of the valve 42*b*, environment air flows into the tube system 40*b* (as already explained). The valve 42*b* is thus activated between the points in time t5 and t6; t7 and t8; t9 and t11 and not activated between the points in time t6 and t7; t8 and t9.

At the point in time t10, the fill level sensor 30*b* outputs a signal that the temporary storage 28*b* is filled with toner material 12 up to the preset fill level, whereupon the valve 42*b* is subsequently not activated again until the fill level sensor 30*b* outputs a signal that the preset fill level has been under-run. Between the point in time t9 and t10, the fill level sensor 30*a* outputs a signal that the fill level has been under-run in the temporary storage 28*a*. The valve 42*a* is subsequently activated in the same manner as the valve 42*b* beforehand, whereby the valve 42*a* is activated between the points in time t12 and t13; t14 and t15 and is not activated between points in time t13 and t14. The valve 42*a* is thereby closed between the points in time t13 and t14 as well as after the point in time t15, whereby environment air can flow into the tube system 40*a*. Between the point in time t14 and t15, the fill level sensor 30*a* outputs a signal that the preset fill level has been reached. The valve 42*a* is thereupon not activated again. After the point in time t15, the valves 42*a*, 42*b* are not activated again until at least one fill level sensor 30*a*, 30*b* outputs a signal that one of the preset fill level limit values has been under-run.

Given a simultaneous under-run of the preset fill levels, the activation of the valves 42*a*, 42*b* occurs serially and alternately. As already explained, a dead time that has at least the same duration as the fall time of the valve 112, 42*a*, 42*b* is provided between respectively two activation cycles.

Figure 10:
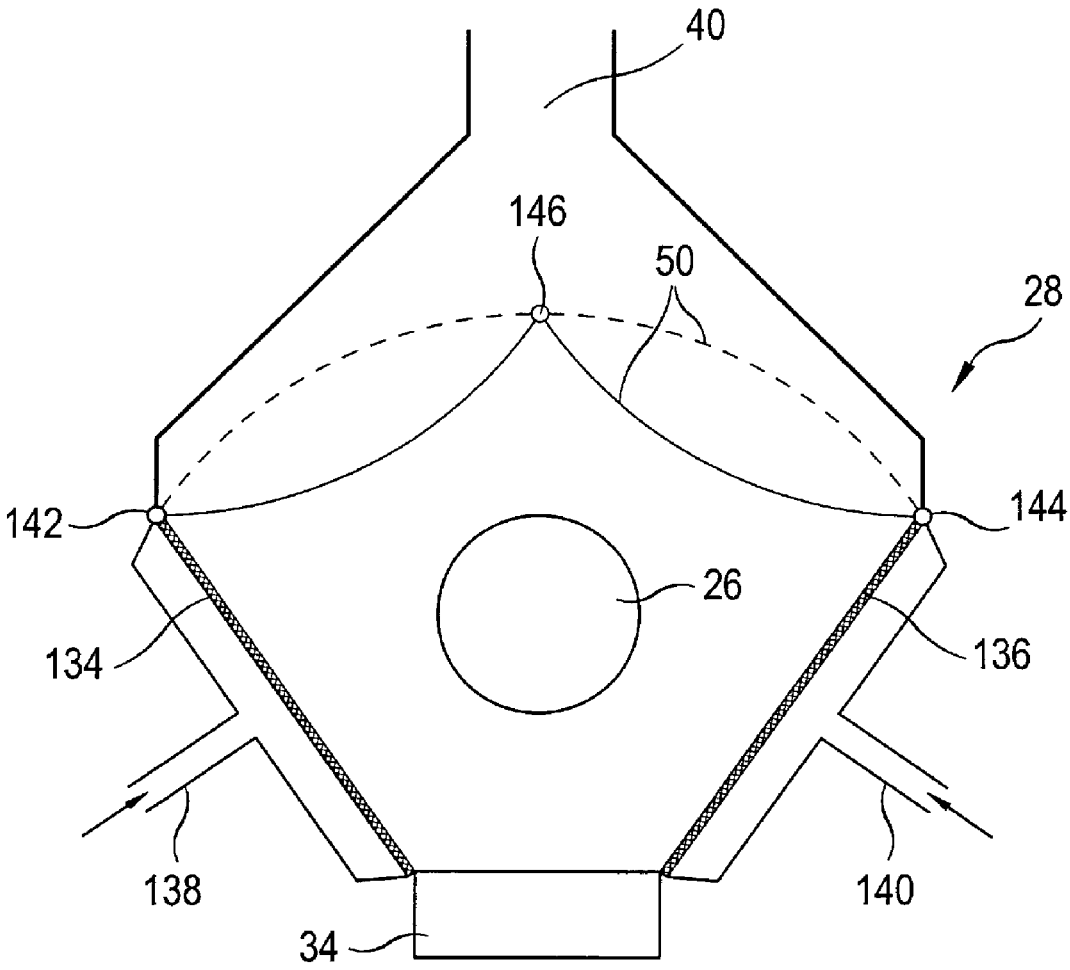
FIG. 10 illustrates a filter arrangement to separate a toner material-air mixture.

A cross-section of the temporary storage 28 is shown in FIG. 10. The outer walls of the temporary storage 28 have air-permeable regions that are arranged funnel-shaped at the bottom towards the dosing device 34. The air-permeable regions 134, 136 are partitioned airtight from the environment air, whereby the air quantity allowed through the air-permeable regions 134, 136 can be adjusted via air feeds 138, 140. The quantity of air introduced via the air feeds 138, 140 can, for example, be introduced with pressurized air, or environment air can simply stream back through the air feeds when a negative pressure prevails in the temporary storage 28.

As already explained in connection with FIGS. 1 through 9, toner material and air is drawn in through the tube system 26 via the tube system 26. For this, a negative pressure is applied at the temporary storage 28 with the aid of a tube system 40. The air is thus sucked from the tube system 26 into the tube system 40. As already explained, toner material 12 is thereby conducted from the reservoir 16 into the temporary storage 28. The filter 50 separates the toner material-air mixture conveyed via the tube system 26, whereby it allows only air to pass through on the clean air side (i.e. facing the tube system 40) and the toner material 12 remains at the filter 50. The filter 50 comprises, for example, an air-permeable and toner-tight fleece material and is connected toner-tight with the housing of the temporary storage 28 at the points 142, 144. The filter is held approximately in its center line at the point 146 with the aid of a retaining device, such that it cannot fall onto toner material 12 present in the temporary storage 28.

Upon application of negative pressure with the aid of the vacuum blower in the tube system 40, a toner material-air mixture is conveyed from the toner reservoir 16 via the tube system 26. The filter 50 assumes the position (shown with the aid of a dashed line) via the air flow. Toner material 12 from the toner material-air mixture thereby affixes to the filter 50. The air conveyed via the tube system 26 flows through the filter 50 into the tube system 40 on the filter-clean air side. Not only does the toner material-air mixture thereby flow through the tube system 26, but rather air also flows through the air-permeable regions 134, 136 of the temporary storage 28. A toner material-air mixture that particularly simply flows into the dosing device 34 is thereby generated in the temporary storage 28 with the toner material 12 located therein.

If negative pressure is no longer generated in the tube system 40, in that, for example, the valve 42 is closed or the vacuum blower 46 is deactivated, air no longer flows through the filter 50 from the temporary storage 28 into the tube system 40. The filter 50 thereby falls from the position shown with dashed lines into the position shown with solid lines. Via the movement from the position shown with dashed lines into the position shown with solid lines, toner material 12 that has affixed to the surface of the filter 50 is shaken off. The shaken-off toner material 12 falls into the temporary storage 28. This effect of the shake-off can, for example, be amplified in that a negative pressure is applied in the tube system 40 opposite the temporary storage 28, whereby air flows through the filter 50 from the filter-clean air side, whereby toner material 12 adhering to the filter 50 loosens and falls into the temporary storage 28.

The filter 50 is formed as a flexible filter cloth, in particular as a material cloth or as a plastic tissue and is attached slack in a rest position. Via an abrupt stop of the negative pressure on the filter-clean air side, or via pressure surge from the filter-clean air side, the filter cloth 50 attached slack is moved like a whip and thereby shakes adhered toner material 12 off. The toner material 12 is thereby mechanically not excessively stressed; the toner material is in particular not crushed or abraded on the walls or on the filter 50. It is thereby achieved that the mechanical and electrostatic properties of the toner material 12 are not changed. Maintenance-intensive mechanical devices for cleaning of the filter 50 are also largely done away with. This cleaning can also thereby be particularly cost-effectively implemented.

Also referenced in this context are the patent applications with the internal file number 2000E0510 and 98E801, submitted simultaneously by the applicant with this patent application, which concern a method and a device for the transport of toner material from a reservoir. Both of these patent applications are herewith incorporated into the present specification by reference.

Although preferred exemplary embodiment are shown and specified in detail in the drawings and in the preceding specification, this should be viewed as exemplary only and not as limiting the invention. It is noted that only the preferred exemplary embodiments are shown and described, and all variations and modifications that presently and in the future lie within the scope of the invention should be protected.

We claim as our invention:

1. A device for dosing toner material in an electrophotographic printer or copier, comprising:

a paddlewheel with paddles rotatably arranged at a lower opening of a toner reservoir from which toner material falls into at least one bucket chamber, a rotation axis of the paddle wheel running substantially horizontal;

the paddlewheel sealing an opening of the toner reservoir;

an actuator to rotate the paddlewheel such that given a rotation the toner material is conveyed by the bucket chamber into a region below said rotation axis; and a screw conveyor arranged below the paddlewheel which further conveys toner material downwards from the paddlewheel, a quantity of the toner material conveyed by the paddlewheel being greater than a quantity conveyed by the screw conveyor.

2. A device according to claim 1 wherein sealing elements past which the paddles are directed upon rotation of the paddlewheel are arranged at least on circumferential sides of the paddlewheel in a circumference direction in a region to a right and left of the rotation axis.

3. A device according to claim 2 wherein the paddles slide on the sealing elements.

4. A device according to claim 3 wherein connection elements are provided that connect the sealing elements toner-tight with an outer wall of the toner reservoir near the opening.

5. A device according to claim 1 wherein the toner material falls downwards from the bucket chamber into a temporary storage.

6. A device according to claim 1 wherein the opening of the toner reservoir extends lengthwise in a direction of the rotation axis of the paddlewheel, and a width of the paddlewheel substantially corresponds with a length of the opening.

7. A device according to claim 6 wherein walls of the toner reservoir contain at least one gas-permeable region through which air is supplied to the toner material in the toner reservoir, a free-flowing toner material-air mixture being created.

8. A device according to claim 1 wherein walls of the toner reservoir taper off in a funnel shape at least in a region near the opening.

9. A device according to claim 1 wherein paddles of the paddlewheel extend substantially from the rotation axis in a radial direction.

10. A device for dosing toner material in an electrophotographic printer or copier, comprising:

a paddlewheel with paddles rotatably arranged at a lower opening of a toner reservoir from which toner material falls into at least one bucket chamber, a rotation axis of the paddle wheel running substantially horizontal;

the paddlewheel sealing an opening of the toner reservoir;

an actuator to rotate the paddlewheel such that given a rotation the toner material is conveyed by the bucket chamber into a region below said rotation axis;

a screw conveyor arranged below the paddlewheel which further conveys toner material downwards from the paddlewheel, a quantity of the toner material conveyed by the paddlewheel being greater than a quantity conveyed by the screw conveyor; and wherein an excess quantity conveyed by the paddlewheel remains in the bucket chamber.

11. A method for dosing toner material in an electrophotographic printer or copier, comprising the steps of:

introducing toner material into at least one bucket chamber of a paddlewheel that is rotatably arranged at an opening situated at a bottom of a toner reservoir, a rotation axis of the paddlewheel running substantially horizontal;

sealing said opening of the toner reservoir by the paddlewheel;

as the paddlewheel rotates, conveying the toner material in the bucket chamber into a region below the rotation axis; and conveying the toner material conveyed downwards from the paddlewheel with aid of a screw conveyor such that a quantity of the toner material conveyed by the paddlewheel is greater than a quantity conveyed by the screw conveyor.

12. A method for dosing toner material in an electrophotographic printer or copier, comprising the steps of:

introducing toner material into a plurality of bucket chambers formed by paddles of a paddlewheel that is rotatably arranged at an opening situated at a bottom of a toner reservoir;

as the paddlewheel rotates, conveying the toner material in the bucket chambers into a region below the paddlewheel which assists in sealing the toner reservoir together with the paddlewheel; and conveying the toner material conveyed from the paddlewheel with aid of a screw conveyor such that a quantity of the toner material conveyed by the paddlewheel is greater than a quantity conveyed by the screw conveyor.

13. A toner reservoir for providing toner material to an electrophotographic printer or copier, comprising:

a housing having a toner discharge opening at one end for delivering the toner material contained in the housing to the printer or copier, said housing having adjacent said discharge opening walls which are inclined inwardly towards said discharge opening;

said discharge opening having a shape for accommodating at least a portion of a paddlewheel having at least one bucket chamber which conveys the toner material from the reservoir into the printer or copier; and a screw conveyor beneath the paddle wheel which further conveys toner material downwards from the paddlewheel, a quantity of the toner material conveyed by the paddlewheel being greater than a quantity conveyed by the screw conveyor, and wherein an excess access quantity conveyed by the paddlewheel remains on the bucket chamber of the paddlewheel.

14. A reservoir of claim 13 wherein the inwardly inclined walls of the reservoir at the discharge opening are rounded and extend in a lateral direction parallel to an axis of said paddlewheel.

15. A reservoir of claim 13 wherein the discharge opening has straight edges parallel to an axis of rotation of the paddlewheel, said straight edges being terminations of said inclined walls of the reservoir.

16. A reservoir of claim 13 wherein said inclined walls are curved.

17. A toner reservoir for providing toner material to an electrophotographic printer or copier, comprising:

a housing having a toner discharge opening at one end for delivering the toner material contained in the housing to the printer or copier, said housing having adjacent said discharge opening walls which are inclined inwardly towards said discharge opening;

said discharge opening having a shape for accommodating at least a portion of the paddlewheel which conveys the toner material from the reservoir into the printer or copier; and said reservoir at its discharge opening has straight edges at ends of the paddlewheel, and wherein walls of said reservoir at said ends of the paddlewheel are vertical and terminate at the paddlewheel ends in an inclined portion.

18. A reservoir of claim 13 wherein at said discharge opening a flat supporting surface is provided for mating with a support surface on the printer or copier at said paddlewheel.

19. A toner reservoir for providing toner material to an electrophotographic printer or copier, comprising:

a housing having a toner discharge opening at one end for delivering the toner material contained in the housing to the printer or copier, said housing having adjacent said discharge opening curved walls; and said discharge opening having opposite straight edges at ends of said curved walls, said straight edges running parallel to a rotation axis of a paddlewheel and wherein said discharge opening accommodates at least a portion of a paddlewheel having at least one bucket chamber which conveys the toner material from the reservoir into the printer or copier; and a screw conveyor beneath the paddle wheel which further conveys toner material downwards from the paddlewheel, a quantity of the toner material conveyed by the paddlewheel being greater than a quantity conveyed by the screw conveyor, and wherein an excess quantity conveyed by the paddlewheel remains on the bucket chamber of the paddlewheel.

* * * * *